United States Patent [19]

Muchnick

[11] 3,953,030

[45] Apr. 27, 1976

[54] THROW AND CATCH TOY

[76] Inventor: Bruce Muchnick, 9855 Bonner St., Philadelphia, Pa. 19115

[22] Filed: Jan. 14, 1975

[21] Appl. No.: 540,938

[52] U.S. Cl. ..... 273/95 R; 273/26 E; 46/DIG. 1; 2/19; 273/65 E

[51] Int. Cl.[2] ..... A63B 71/02

[58] Field of Search ..... 273/95 R, 96, 102 R, 273/26 E; 2/15, 18, 19, 20; 46/87, 88, DIG. 1

[56] References Cited

UNITED STATES PATENTS

| | | | |
|---|---|---|---|
| 950,083 | 2/1910 | Waring | 2/19 |
| 1,496,824 | 6/1924 | Nixon | 2/19 |
| 1,633,926 | 6/1927 | Craig | 2/19 |
| 3,032,345 | 5/1962 | Lemelson | 46/DIG. 1 |
| 3,141,173 | 7/1964 | Jackson | 2/19 |
| 3,217,333 | 11/1965 | Sweet | 2/18 |
| 3,391,933 | 7/1968 | Cooper | 46/DIG. 1 |
| 3,755,820 | 9/1973 | Petrusek | 2/18 |

*Primary Examiner*—Richard C. Pinkham
*Assistant Examiner*—Marvin Siskind
*Attorney, Agent, or Firm*—Caesar, Rivise, Bernstein & Cohen, Ltd.

[57] ABSTRACT

A throw and catch toy for particular use by young children, mental retardees or handicapped perons to enable the catching of an object thrown without requiring substantial muscular coordination or finger movement of the catching hand. The toy comprises the combination of an inflatable glove having a palm surface upon which plural patches of one component of VELCRO are disposed and a ball having a surface upon which plural patches of the other component of VELCRO are disposed. When the ball is thrown at the glove and makes contact with the palm side thereof the VELCRO components on the ball and glove coact to hold the ball on the glove without requiring the person wearing the glove to use his fingers to grasp the ball to hold it.

9 Claims, 4 Drawing Figures

THROW AND CATCH TOY

This invention relates generally to toys and more particularly to throw and catch toys.

To most young children, mentally retarded persons or handicapped persons learning to catch a ball thrown to them can be a very frustrating experience. It can also prove extremely frustrating to the person teaching. This is due to the fact that catching a ball is a relatively complex psychomotor process involving substantial eye-hand-finger coordination.

As is commonly recognized by educators, frustration works as an enemy to any learning process, particularly with children, since frustration leads to boredom which in turn leads to resignation.

It is a general object of this invention to provide a throw and catch toy which enables one to catch an object thrown and requiring very little or no coordination of finger movement of the person catching. In so doing the process of learning to catch utilizing muscular coordination and finger movement can be made highly reinforcing.

It is a further object of this invention to provide a combination glove and ball, including means for facilitating the catching of the ball by the glove and without requiring the grasping of the ball by the fingers.

It is still a further object of this invention to provide in combination a ball and very large glove including means for facilitating the catching of the ball by the glove, with the large size of the glove minimizing the coordination required of the thrower by providing a larger target area and thereby further enhancing the throwing and catching process.

It is yet a further object of this invention to provide a highly enjoyable throw and catch toy.

These and other objects of this invention are achieved by providing a throw and catch toy comprising in combination hand covering means adapted to be worn on the hand of a user contiguous with the palm thereof and an object to be thrown at the hand covering means to be trapped thereby. The hand covering means provides a surface area upon which is secured one component of a two component fastening system. The two component fastening system comprises a first component including a plurality of loop elements projecting therefrom and a second component including a plurality of hook elements projecting therefrom. The first and second components are arranged to be releasably secured to each other upon contact. The object includes a surface portion upon which the other component of the two component fastening system is secured. When the object is thrown at the hand wearing the hand covering means and makes contact therewith the component on the hand covering means coacts with the component on the object to hold the object thereon without requiring the user to use his fingers to grasp the object to hold it.

Other objects and many of the attendant advantages will be understood by reference to the following detailed description when considered in connection with the accompanying drawings wherein.

Figure 1:
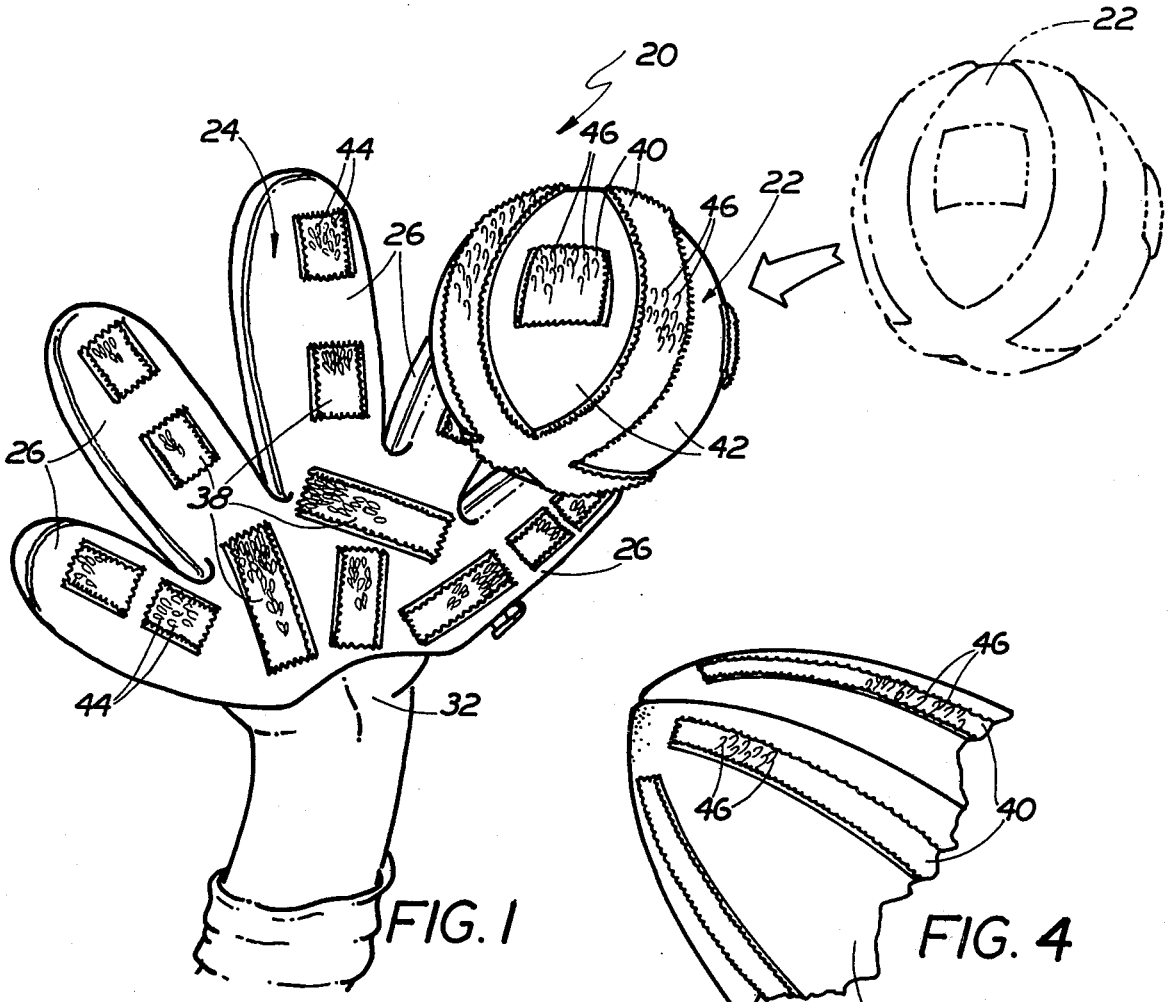
FIG. 1 is a perspective view of the throw and catch toy of this invention in use.

Referring now to the various figures of the drawing wherein like reference characters refer to like parts, there is shown a throw and catch toy generally at 20 in FIG. 1. Basically the toy 20 comprises two components, one component is an object 22 which is adapted to be thrown and the second component 24 is a catching device adapted to catch and trap the object 22 when the object makes contact therewith. In accordance with the preferred embodiment of this invention the catching device is a glove which is worn on the hand of the user and over the palm.

It should be pointed out at this juncture that while a glove is shown as the preferred embodiment of the catching device 24, the device 24 can take various other forms adapted to be worn on the hand and over the palm, e.g., a mitten, a fingerless glove (similar to a golf glove), or a sack worn over the hand. Since the operation of catching is normally accomplished in the palm of the hand, all that is required of any catching device in accordance with this inventionis that it includes some portion worn on the hand of the user and contiguous with the palm of the hand to serve as a catching surface. As will be described in detail later, means are provided on the palm or catching surface of the catching device to facilitate the catching of the object 22 when the object makes contact therewith.

Figure 4:
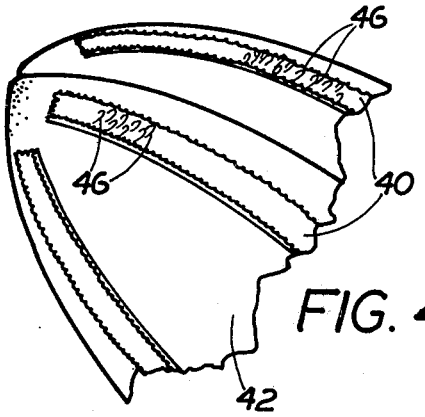
FIG. 4 is a perspective view of a portion of another object to be thrown.

As can be seen in FIG. 1 the object 22 comprises a ball, preferably formed of a lightweight material, such as styrofoam. While the ball of FIG. 1 is of the size and shape of a baseball, it is to be understood that other shaped objects can be used in accordance with this invention. For example, as can be seen in FIG. 4, the object 22 is of the size and shape of a football.

The glove 24 comprises five relatively large fingerlike extensions 26, with each extension being associated with a respective finger of the user's hand. The glove includes a front and a rear side 28 and 30 (FIG. 3), respectively. The front or palm side of the glove serves as the target or object receiving surface thereof while the rear surface serves as the surface against which the palm 32 of the user is placed when wearing the glove.

Figure 2:
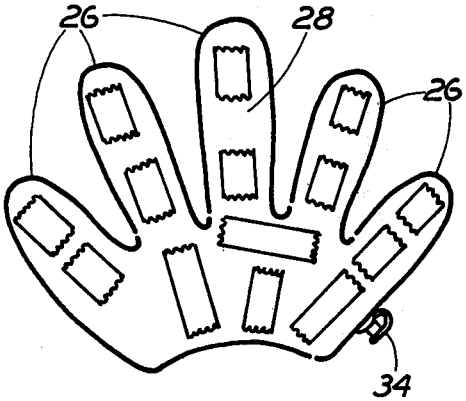
FIG. 2 is a plan view of one side of the catching device.

In accordance with the preferred embodiment of this invention the glove is formed as a hollow, inflatable, thin walled member formed of a plastic, such as vinyl. To that end, a valve 34 (FIGS. 2 and 3) is provided to enable the the glove to be inflated. When inflated the glove is substantially larger than the hand of a child to provide a relatively large target area for the object to be thrown.

Finger receiving means, 36, are provided on the rear side of the glove, with one of such means on each finger-like extension 26. Each of the finger receiving means 36 comprises a pocket formed of a strip of plastic which is heat sealed to the rear side of the finger-like extension. The size of the pocket is of suitable size to receive the finger of a small child closely therein.

Figure 3:
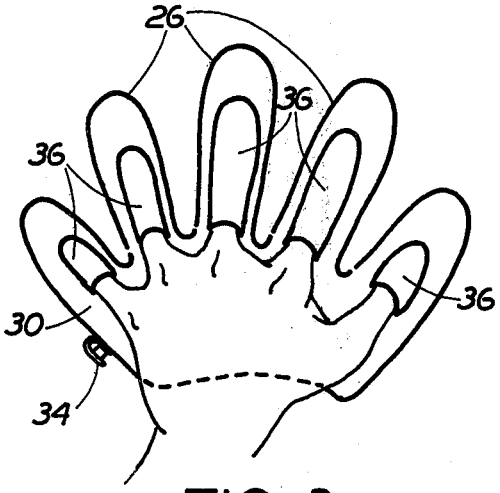
FIG. 3 is a plan view of the reverse side of the catching device.

In FIG. 3 there is shown the manner in which the inflated glove is worn on the hand of a child. As can be seen the palm of the hand is placed against the rear side of the glove and each finger of the hand is inserted within the pocket formed in a respective finger receiving means 36.

In accordance with the preferred embodiment of this invention the thickness of the glove, when inflated, is not too great to preclude the finger-like extensions 26 of the glove from being flexed slightly closed when the fingers of the user's hand are brought together, as in the process of catching. Accordingly, the inflated glove of this invention serves not only as a large, lightweight target and catching device but also permits some degree of finger control to be exercised in the catching operation. Although, as will be seen hereinafter, such control is unnecessary insofar as catching with the invention is concerned, such control is important insofar as teaching one to catch with the use of the fingers when not using the instant invention.

In accordance with the main aspect of this invention the palm or catching surface of the glove includes means for facilitating the catching of the object thrown thereto while the object itself includes means for coacting with the means on the palm surface of the glove to facilitate such operation. To that end, as can be seen in FIGS. 1 and 3, plural patches 38 of one component of a two component fastening system are disposed on the palm surface 28 of the glove and are secured thereto. Similar plural patches 40 of the other component of the two component system are disposed on the surface 42 of the ball 22.

The two component fastening system used in this invention is manufactured by the Velcro Manufacturing Company of Manchester, New Hampshire and is sold under the trademark VELCRO. As is known such a fastening system comprises one component including a plurality of hook elements projecting therefrom while the other component includes a plurality of loop elements projecting therefrom. The two components are adapted to be releasably secured to each other by mere contact with each other. To that end, when the components are brought into contact with each other the hook elements of one component engage to the loop elements of the other component to secure the two components together. By pulling on the components they can be readily separated.

As can be seen in FIG. 1 the patches 38 on the glove 24 are formed of the loop element component of the VELCRO fastening system and thus include plural loops 44 while the patches 40 on the ball 22 are formed of the hook element component and thus include plural hooks 46. Patches 38 and 40 are secured in place in any conventional manner, such as the use of a solvent activated adhesive and are provided over a substantial area on the surface of the ball and the palm surface of the glove. This feature insures that when the ball contacts the glove some portion of the loop components and hook components make contact with each other. While covering the entire surface area of the ball and of the palm of the glove with the respective components will insure that some hooks and loops will always be brought into contact when the ball hits the glove, such a construction is unnecessary and wasteful. Therefore, substantially less than the entire surface area of the ball and palm surface of the glove can be covered and still provide an effective an reliable catching system.

It should be pointed out at this juncture that while in the embodiment disclosed herein the patches 28 are formed of the loop-like components of the fastening system and the patches 40 are formed of the hook-like components, such components can be reversed, if desired. Furthermore, it is to be understood that any loop-like nappy material can be used for the looplike component of the fastening system. In fact it is contemplated that the entire catching component 24 or any part of its palm surface can be formed of such nappy material.

Operation of the throw and catch toy 20 can best be appreciated by reference to FIG. 1 wherein there is shown, via phantom line, ball 22 in the process of being thrown at the glove 24. The catching and trapping of the ball on the glove is shown by the solid lines in the said FIG. 1. As should be appreciated when the ball hits the palm surface of the glove, the hooks on the patches 40 on the contacting surface of the ball contact the loops on the patches 38 on the contacting surface of the glove, whereupon the hooks and loops coact in engagement with each other to effect their securement together. This action effectively traps the ball in place on the glove and without the need for any grasping action by the fingers of the catcher. The ball can be readily removed for another throw and catch operation by merely pulling it from the glove.

It should thus be appreciated that the instant invention provides a throw and catch toy which is instructional and which eliminates need for muscular finger coordination by the catcher. Thus the instant invention enables highly enjoyable catch games to accomplished by children, mentally retarded persons or other handicapped persons not having the requisite coordination to catch normally.

Without further elaboration, the foregoing will so full illustrate my invention, that others may, by applying current or future knowledge, readily adapt the same for use under various conditions of service.

What is claimed as the invention is:

1. A throw and catch toy comprising in combination, hand covering means adapted to be worn on the hand of a user over the fingers and contiguous with the palm, said hand covering being sufficiently flexible to permit it to be flexed slightly closed by the user's fingers, if desired, and an object to be thrown at the hand covering, to be trapped thereby upon contact therewith, said hand covering means being in the form of an inflatable glove having a palm side providing a surface area thereon including one component of a two component fastening system, said two component fastening system comprising a first component including a plurality of loop elements projecting therefrom and a second component including a plurality of hook elements projecting therefrom, said first and second components being arranged to be releasably secured to each other upon contact, said object having a surface portion including the other component of said two component fastening system, whereupon when said object is thrown at the hand wearing the hand covering means and makes contact therewith the component on the hand covering means coacts with the component on the object to catch the object thereon without requiring the user to use his fingers to grasp the object to effect said catching but permitting some finger control in said catching, if desired.

2. The toy of claim 1 wherein said object is a ball.

3. The toy of claim 1 wherein said glove, when inflated, is substantially larger than the hand of a child.

4. The toy of claim 3 wherein the glove includes a rear side having finger receiving recesses therein to enable the glove to be worn on the hand.

5. The toy of claim 4 wherein said object is a ball.

6. The toy of claim 1 wherein said component having the hook elements thereon is disposed on said object and wherein said component having the loop elements thereon is disposed on the surface area of the glove.

7. The toy of claim 6 wherein the component on the glove is in the form of plural patches disposed over a substantial area on the palm side thereof.

8. The toy of claim 7 wherein the component on the object is in the form of plural patches disposed over a substantial area of the surface of said object.

9. The toy of claim 8 wherein said object is a ball.

* * * * *